United States Patent [19]

Swafford et al.

[11] 3,970,242

[45] July 20, 1976

[54] HOSIERY ENVELOPE

[75] Inventors: Clifton S. Swafford; Thurman T. Caldwell; William J. Dungan, all of Charlotte, N.C.

[73] Assignee: Rexham Corporation, New York, N.Y.

[22] Filed: July 1, 1974

[21] Appl. No.: 484,659

[52] U.S. Cl. ..... 229/80; 229/48 SB; 229/48 T

[51] Int. Cl.[2] ..... B65D 27/14

[58] Field of Search ..... 229/80, 81, 62, 48 T, 229/48 SB

[56] References Cited

UNITED STATES PATENTS

| | | | |
|---|---|---|---|
| 460,397 | 9/1891 | Morgan | 229/81 |
| 590,890 | 9/1897 | Holly | 229/81 |
| 1,974,339 | 9/1934 | McDonald | 229/80 |
| 2,330,045 | 9/1943 | Georgiou | 229/81 X |
| 2,542,245 | 2/1951 | Gottesman | 229/81 X |
| 3,079,066 | 2/1963 | Roop | 229/62 |
| 3,124,299 | 3/1964 | Stone et al. | 229/81 |

FOREIGN PATENTS OR APPLICATIONS

| | | | |
|---|---|---|---|
| 716,929 | 8/1965 | Canada | 229/62 |
| 468,195 | 6/1937 | United Kingdom | 229/81 |
| 494,159 | 10/1938 | United Kingdom | 229/80 |

*Primary Examiner*—Stephen P. Garbe
*Attorney, Agent, or Firm*—Mandeville and Schweitzer

[57] ABSTRACT

Disclosed herein is a stocking envelope having an improved sealing arrangement provided by a pair of stripes of "bimodal adhesive" laid down wet during initial envelope formation to join the glue flaps of the envelope to associated major envelope panels. Subsequently, portions of the dried stripes of "bimodal adhesive" are reactivated by heat during envelope closing to seal an overlying closing flap to a major panel through special apertures formed in the glue flaps.

6 Claims, 4 Drawing Figures

HOSIERY ENVELOPE

BACKGROUND AND SUMMARY OF THE INVENTION

The folded envelope prior art is replete with disclosures of a plethora of "two-dimensional" envelopes, i.e., those in which juxtaposed front and rear walls are articulated directly to one another along score lines and "three-dimensional" envelopes, i.e., those in which the front and rear juxtoposed walls are connected by side walls to provide the envelope with depth or bulk. In all of these envelopes, many different sealing and opening arrangements are employed incuding those for preventing premature or unauthorized opening of or tampering with the envelopes, for facilitating sealing of the envelopes, for facilitating reuse of the envelopes through reclosable construction features, etc.

The present invention is directed to a simplified envelope construction in which the glue flaps used to complete the initial envelope structure are adhered to the major envelope panels by a special "bimodal" type of adhesive, which may be subsequently heat activated for the adhesion of an overlying closing flap to one of the major panels through special openings or apertures formed in the glue flaps. These openings are positioned in registry with the underlying stripes of adhesive and the overlying areas of the closing flaps which are to be contacted by the heat-activated adhesive. This new construction simplifies the manufacture and use of envelopes, especially envelopes of the type ordinarily used to package delicate articles, such as hosiery.

For a better understanding of the principles of the present invention and a more complete appreciation of the attendant advantages derived from its practice, reference should be made to the following detailed description taken in conjunction with the accompanying drawings.

DESCRIPTION OF THE DRAWINGS

FIG. 1*a* is a perspective view of the embodiment of FIG. 1, in modified form, showing an alternative illustration of the arrangement of certain parts of the envelope embodying the principles of the invention;

DETAILED DESCRIPTION OF THE PRESENT INVENTION

Figure 1:
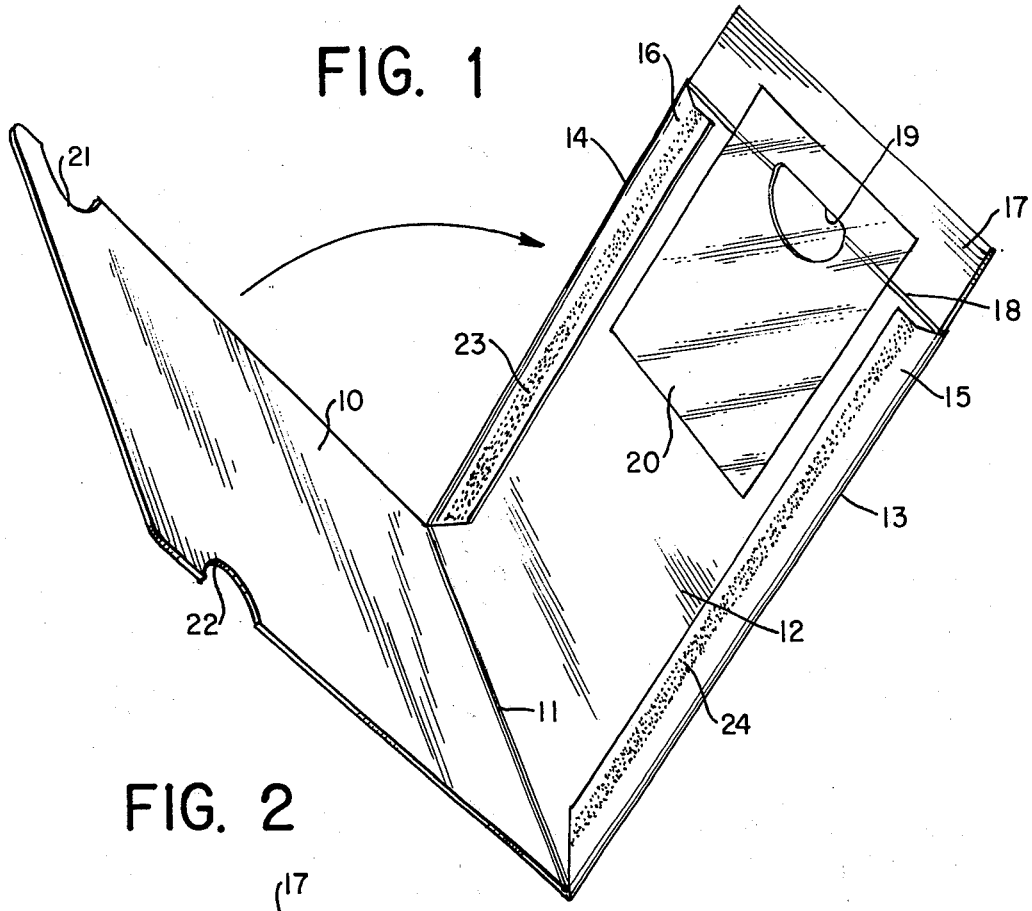
FIG. 1 is a perspective view of the envelope embodying the principles of the present invention during preliminary stages of its formation and prior to the adhesion of the rear wall panel to the infolded glue flaps.

Referring now to the drawings, a new and improved envelope 9 having a front wall 12 and rear wall 10 is shown partially completed. For the purposes of illustration, the envelope 9 is shown to be a "two-walled" or "two-dimensional" flat envelope (although, as will be readily appreciated, the principles of the present invention may be practiced in "three-dimensional" paperboard containers of six-walled configuration as well as the two-walled configuration illustrated herein). The paperboard blank from which the new envelope 9 is erected includes a generally rectangular rear wall panel 10 articulated along a score line 11 to a front wall panel 12, which is essentially the same width but slightly longer than the rear wall panel 10. Articulated to the opposite side edges of the front wall panel along score lines 13, 14 are glue flaps 15, 16. A closing flap 17 is articulated to the upper edge of the front wall 12 along a score line 18 parallel to the score line 11.

As is conventional in hosiery envelopes of this general type, the bottom and top edges of the glue flaps 15, 16 are relieved, as shown in the drawings. A display window 19 intersects score line 18 and extends from the upper portions of the front wall 12 into contiguous upper portions of the closing flap 17, which window 19 is closed by an overlying transparent membrane 20, such as clear cellophane.

In accordance with the principles of the invention, the upper portion of the rear wall 10, at opposite side edges thereof, is provided with a pair of sealing apertures 21, 22, which, advatageously, are semi-circular in configuration, but which, of course, may be of any shape desired or found necessary for the subsequent fact-to-face sealing of the cover flap 17 therethrough to the glue flaps 15, 16. More specifically, to effect the subsequent sealing and closing of the envelope 9, in accordance with the present invention, the new and improved envelope is initially formed and completed by the use of a pair of stripes 23, 24 of "bimodal" adhesive (e.g., a polyvinyl acetate type adhesive, or a "hot melt" adhesive), which are applied in liquid or molten state to the glue flaps 15, 16 as shown in FIG. 1. Specifically, the adhesive used in the stripes 23, 24 is "bimodal"; that is to say, it is originally laid down as conventional "glue" in a wet state for the adhesion of the envelope rear wall to the infolded glue flaps 15, 16 to establish an envelope structure in a generally conventional fashion. However, critically and more importantly, the adhesive stripes 23, 24 may be heat reactivated at a subsequent time for adhesion of the infolded closing flap 17 directly thereto through the sealing apertures 21, 22.

Figure 2:
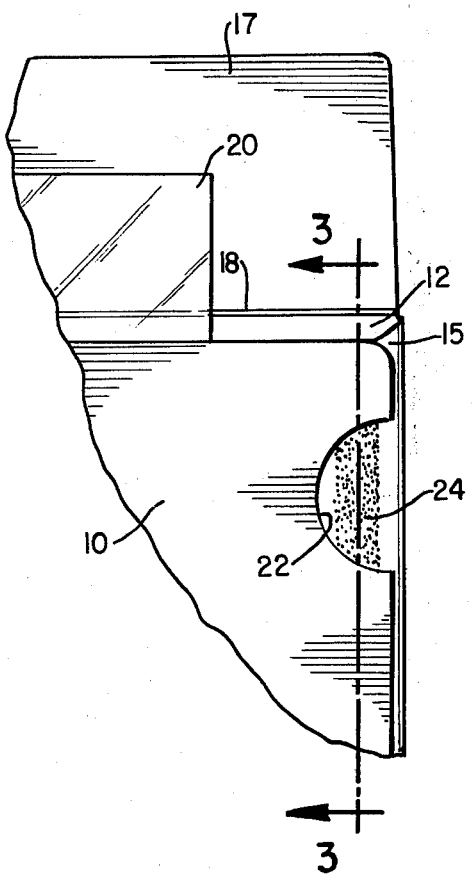
FIG. 2 is an enlarged, fragmentary plan view of the completed but unclosed envelope showing detals of its construction.
Figure 3:
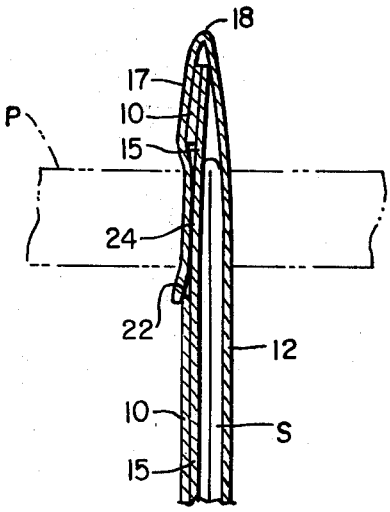
FIG. 3 is a fragmentary, cross-sectional view of a completely closed and sealed envelope embodying the principles of the invention, which view is taken along line 3—3 of FIG. 2.
Figure 1:
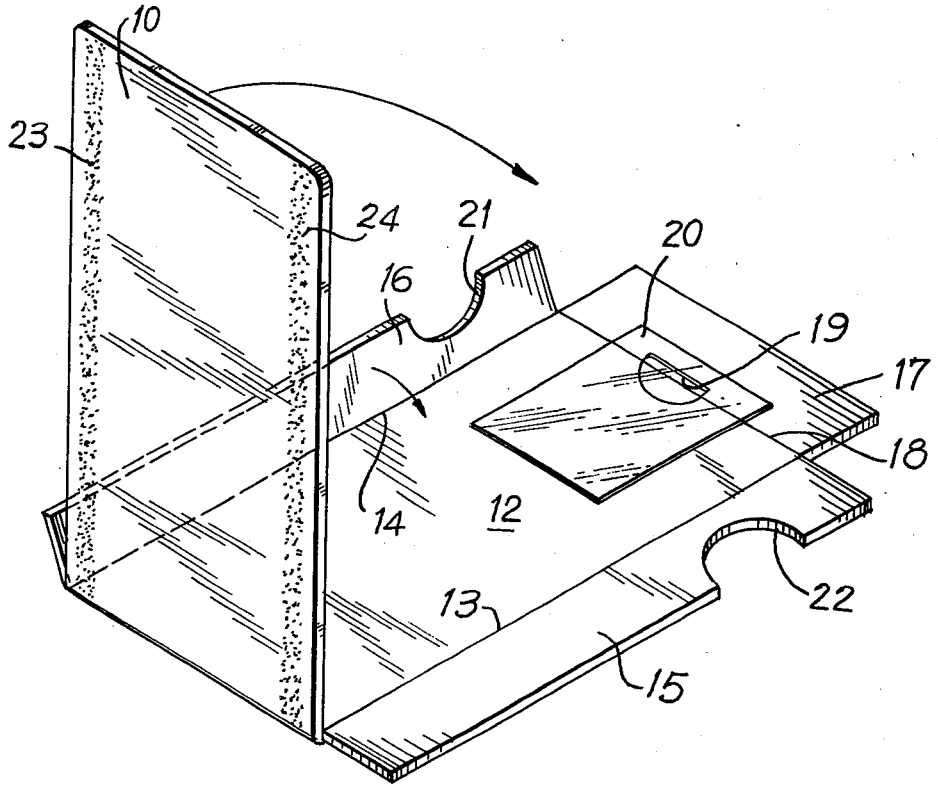

As will be noted from FIG. 2, the apertures 21, 22 are disposed within a sealing zone which is not greater than the length of the closing flap 17, as will be understood. When the preformed envelope has been filled with merchandise, such as stockings S (FIG. 3), the adhesive stripes 23, 24 in the areas in which they are exposed through the sealing apertures 21, 22, are heated and activated to accommodate the secure adhesion of the opposite ends of the closing flap 17 directly to the infolded glue flaps 15, 16. This may be effected by any one of numerous well known techniques known to the art including the use of a heated platen P, which applies both heat and pressure to the sealing zone through the folded closing flap 17 to adhere the inner surfaces thereof to the heat activated adhesive stripe 24 through the opening 22.

As a further important and critical advantage and benefit to be derived from the practice of the principles of the present invention, the above-described method of forming envelopes and subsequently sealing the same eliminates any "blocking" problems ordinarily associated with envelopes of this type when the envelope closing adhesive stripes or the like are applied to the inner surfaces of the closing flaps 17 or otherwise exposed along the outer surfaces of the rear wall 10, as is the case with conventional envelopes. As will be appreciated, the adhesive stripes 23, 24, which function both to form the envelope initially in the envelope manufacturer's plant and to seal the envelope closed at a later time in the packager's plant, will be prevented from "blocking", when the new envelopes are stacked in a pile, by virtue of the fact that the stripes 23, 24, even if not completely dry in the initial formation stages of envelope construction, will be separated and spaced from one another in the pile or stack of envelopes by the layers of paperboard comprising the rear walls 10 of the cartons, as will be understood.

The new and improved envelope construction of the present invention and the method of forming and sealing the same are disclosed hereinabove for purposes of illustration only, it being understood that the principles of the invention may be applied in a wide variety of envelope and carton constructions. For example, as shown in FIG. 1*a* the apertures 21, 22 may be formed in the glue flaps 15, 16, which may be folded over and adhered to adhesive stripes 23, 24 deposited on the rear wall 10. Accordingly, reference should be made to the following appended claims in determining the full scope of the present invention.

We claim:

1. An improved envelope construction, comprising
a. juxtaposed parallel front and rear wall panels;
b. means joining said front and rear walls at bottom edges thereof;
c. a closing flap panel articulated to said front wall;
d. means joining said front and rear walls along the side edges thereof including glue flap panels;
e. said glue flap panels lapping the side edges of said rear wall panel;
f. said rear wall including an upper sealing zone adapted to be contacted by said closing flap;
g. a pair of sealing aperture means defined in the side edges of said rear wall panel within said sealing zone;
h. a bimodal adhesive layer deposited upon said glue flap panels and joining said glue flap panels with said rear panel;

i. portions of said adhesive layer being exposed through said sealing apertures, whereby said closing flap is adapted to be adhesively joined directly to the innermost one of said glue flap panels and said rear wall panel through said apertures to close said envelope.

2. An improved envelope construction, comprising
a. juxtaposed parallel front and rear wall panels;
b. means joining said front and rear walls at bottom edges thereof;
c. a closing flap panel articulated to said front wall;
d. means joining said front and rear walls along the side edges thereof including glue flap panels;
e. said glue flap panels lapping the side edges of said rear wall panel;
f. said rear wall including an upper sealing zone adapted to be contacted by said closing flap;
g. a pair of sealing aperture means defined in the side edges of each of said glue flap panels within said sealing zone;
h. a bimodal adhesive layer deposited upon said rear wall panel and joining said glue flap panels with said rear panel;
i. portions of said adhesive layer being exposed through said sealing apertures, whereby said closing flap is adapted to be adhesively joined directly to the innermost one of said glue flap panels and said rear wall panel through said apertures to close said envelope.

3. The envelope of claim 1, in which
a. said adhesive is heat reactivatable.

4. The envelope of claim 1, in which
a. said front wall defines a viewing window.

5. The envelope of claim 4, in which
a. said window extends into said closing flap.

6. The envelope of claim 1, in which
a. said means joining said front and rear walls at bottom edges thereof is a score line; and
b. said glue flap panels are articulated directly to said front wall side edges along parallel score lines.

* * * * *